US007578418B2

(12) United States Patent
Milian

(10) Patent No.: US 7,578,418 B2
(45) Date of Patent: Aug. 25, 2009

(54) DISPENSER DEVICE INCLUDING A COVERING TUBE FOR A DIP TUBE

(75) Inventor: Alex Milian, Breteuil sur Iton (FR)

(73) Assignee: Valois S.A.S., Le Neubourg (FR)

( * ) Notice: Subject to any disclaimer, the term of this patent is extended or adjusted under 35 U.S.C. 154(b) by 120 days.

(21) Appl. No.: 11/260,218

(22) Filed: Oct. 28, 2005

(65) Prior Publication Data

US 2006/0118579 A1 Jun. 8, 2006

(30) Foreign Application Priority Data

Oct. 29, 2004 (FR) ..... 04 52486

(51) Int. Cl.
*B65D 88/54* (2006.01)

(52) U.S. Cl. ..... 222/321.9; 222/382; 222/464.5

(58) Field of Classification Search ..... 222/321.1, 222/321.7, 321.9, 464.5, 159, 464.3, 78, 222/464.1, 382
See application file for complete search history.

(56) References Cited

U.S. PATENT DOCUMENTS 2,772,116 A * 11/1956 Dobkin ..... 222/190
4,278,189 A * 7/1981 Kirk, Jr. ..... 222/321.2
6,142,338 A * 11/2000 Pellicano ..... 222/1
6,269,976 B1 * 8/2001 DeJonge ..... 222/82

* cited by examiner

*Primary Examiner*—Kevin P Shaver
*Assistant Examiner*—Stephanie E Tyler
(74) *Attorney, Agent, or Firm*—Sughrue Mion, PLLC

(57) ABSTRACT

A fluid dispenser device comprising: a transparent receptacle defining a fluid reservoir, said receptacle including a neck defining an opening; a pump mounted in the opening of the neck, the pump being capable of delivering a quantity of fluid contained in said reservoir, the pump including a substantially cylindrical body that is terminated by an inlet sleeve; a dip tube connected to the inlet sleeve and extending into the reservoir so as to deliver the fluid contained in the reservoir to the pump, once the pump has been actuated; and a covering tube sheathing at least part of said dip tube; wherein said covering tube is fastened to the inlet sleeve of the pump.

28 Claims, 2 Drawing Sheets

DISPENSER DEVICE INCLUDING A COVERING TUBE FOR A DIP TUBE

The present invention relates to a fluid dispenser device, and more particularly to a covering tube that is capable of sheathing at least part of the dip tube connected to a dispenser member.

BACKGROUND OF THE INVENTION

Cosmetics, perfumery, and pharmacy are advantageous, but not exclusive, fields of application of the present invention.

Dispenser devices generally comprise a dispenser member mounted on a receptacle containing a fluid to be dispensed. The dispenser member can be a pump or a valve that is capable of dispensing fluid once actuation has taken place by means of a pushbutton. In order to supply the dispenser member with fluid, a dip tube is connected to the member and extends into the receptacle. Such a dip tube thus makes it possible to ensure that fluid can always be taken from the receptacle so as to be dispensed.

However, for receptacles made out of transparent or translucent materials such as glass or certain plastics materials, a dip tube generally imparts an unattractive aspect to the dispenser device, and that is particularly inappropriate for so-called luxury goods such as bottles of perfume or dispensers of care cream or other lotions. Such goods require the manufacturer to pay particular attention to the appearance of the device, so that the consumer is attracted not only to the fragrant qualities of the chemical substance contained in the receptacle, but also to the appearance qualities of the device.

To resolve that problem, a covering tube positioned around the dip tube has already been used in the prior art. Such a tube of a design that is generally particularly attractive thus guarantees that the dip tube is hidden.

However, fastening such a covering tube remains particularly problematic. The fastening of said covering tube can result in it being unstable, and thus being capable of becoming detached from its anchor place, or it can result in the dispenser device being complicated to assemble. Such complexity can result in the need to modify the component parts of the device so as to adapt the covering tube to the dispenser device. Naturally, such adaptation creates increased expense for the manufacturer, and can also be responsible for the appearance of various problems such as difficulty in sealing the device.

OBJECTS AND SUMMARY OF THE INVENTION

An object of the present invention is thus to remedy the problem of holding a covering tube around a dip tube.

Another object of the present invention is to enable the covering tube to be assembled quickly and easily.

The present invention thus provides a fluid dispenser device comprising: a transparent receptacle defining a fluid reservoir, said receptacle including a neck defining an opening; a pump mounted in the opening of the neck, the pump being capable of delivering a quantity of fluid contained in said reservoir, the pump including a substantially cylindrical body that is terminated by an inlet sleeve; a dip tube connected to the inlet sleeve and extending into the reservoir so as to deliver the fluid contained in the reservoir to the pump, once the pump has been actuated; and a covering tube sheathing at least part of said dip tube; wherein said covering tube is fastened to the inlet sleeve of the pump. By fastening the covering tube to the inlet sleeve, fastening can thus be performed easily, e.g. by mutual engagement, and also does not require the dispenser device to be modified structurally in any way. Naturally, the receptacle is at least partially or locally transparent so as to enable the covering tube to be seen.

Advantageously, said covering tube is not in sealed contact with the receptacle, and in particular with the neck. This characteristic thus makes it possible to prevent the covering tube from being displaced, deformed, or even squashed while the various component parts of the dispenser device are being assembled. The covering tube also does not provide sealing in the neck.

Advantageously, said covering tube is fastened solely to the inlet sleeve. This means that the covering tube is not in contact with the body of the pump, except at the inlet sleeve.

Advantageously, said covering tube presents a diameter that is slightly smaller than the diameter of the opening defined by the neck of the receptacle, so that said covering tube can be inserted easily, while the pump is being mounted in the opening of the neck of the receptacle. Mounting a covering tube in a receptacle is thus made particularly easy, and avoids any need for extremely minute adjustments to be made to the machines used to assemble the pump on the receptacle.

Advantageously, said inlet sleeve presents an inside surface and an outside surface, said dip tube being maintained securely engaged with said inside surface, and said covering tube being maintained securely engaged with said outside surface. This configuration is particularly suitable since it can optionally be used to minimize the space occupied by the covering tube in the fluid reservoir. Furthermore, this configuration provides a solid anchor for anchoring the covering tube around the dip tube at a portion of the pump that does not suffer from the problem of deformation. The body of the pump is deformed while the actuator rod is being moved down and up. By keeping out of contact with the body, the covering tube does not hinder the proper operation of the actuator rod.

Advantageously, a fraction of the covering tube is positioned in the opening of the neck of the receptacle, and extends around the body of the pump. The user thus has the impression that the covering tube is fastened in the neck.

Advantageously, the receptacle comprises a side wall extending between a top end including the neck of the receptacle and a bottom end defining a bottom wall of the receptacle, said dip tube and said covering tube each presenting a free bottom end, the bottom end of the dip tube being situated closer to the bottom wall of the receptacle than the bottom end of the covering tube.

In an advantageous embodiment, said covering tube includes a bushing in clamping engagement on said inlet sleeve, said bushing, preferably made out of plastics material, serving as a support for an overtube, preferably made out of metal, said overtube being engaged around said bushing.

Advantageously, said bushing includes a top edge that extends radially outwards and that is suitable for serving as an abutment to said overtube engaged around said bushing, said top edge being advantageously situated at the height of the neck.

Advantageously, a vent hole is provided between the pump and the covering tube so as to enable the air that is trapped in an intermediate gap situated between the covering tube and the dip tube to escape.

Advantageously, said covering tube includes a top end sheathing said body of the pump, said top end presenting a diameter that is slightly greater than the diameter of the body of the pump so as to leave a gap between said top end and said body, and further includes an anchor sleeve that underlies the top end, said anchor sleeve presenting a diameter that is smaller than the diameter of the top end, and being securely engaged on said inlet sleeve.

BRIEF DESCRIPTION OF THE DRAWINGS

Other characteristics and advantages of the present invention appear more clearly from the following detailed description, made with reference to the accompanying drawings, and in which.

MORE DETAILED DESCRIPTION

Figure 1A:
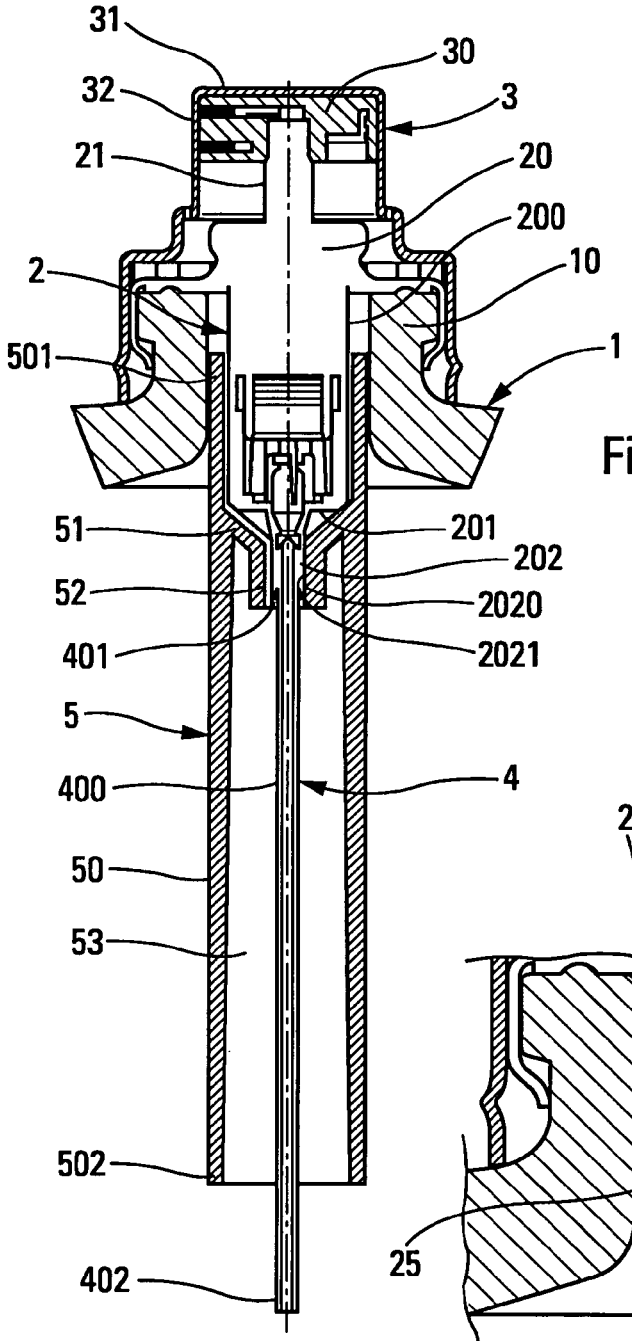
FIG. 1*a* is a truncated view in longitudinal section showing a dispenser device provided with a covering tube for a dip tube, and constituting a first embodiment of the invention.

The description begins with the elements that are common to both embodiments of a covering tube for a dip tube, and then the two embodiments are described with reference to the corresponding illustrative figures.

The present invention includes a transparent receptacle 1 defining a fluid reservoir. Only part of the receptacle is shown in the figures. In the present specification, the term "transparent" is used to cover "translucent", i.e. not completely opaque. In conventional manner, such a receptacle comprises a side wall presenting a bottom end that is closed by a bottom wall (not shown), and a top end provided with a neck 10 defining an opening. The receptacle can be made out of any appropriate material, such as glass or plastics material, and can present any appropriate shape.

A dispenser member 2 is also provided. The dispenser member can be a pump, for example, or in some circumstances, can even be a valve. The dispenser member includes a body 20 including a cylinder 200, a constriction surface 201, and a single inlet sleeve 202.

The cylinder 200 includes a top end defining an opening. In the embodiments shown, the opening thus makes it possible to insert an actuator rod 21 that is capable of sliding down and up in sealed manner in said body so as to cause the fluid to move. The actuator rod co-operates with a portion of the body to define a metering chamber that is generally provided with a top valve and with a bottom valve. The actuator rod generally defines a fluid outlet duct enabling the fluid contained in the metering chamber to be expelled. The operation of such a dispenser member is known in the prior art, and is therefore not described in greater detail.

The constriction surface 201 forms the junction between the cylinder 200 and the inlet sleeve 202. The constriction surface can correspond to a surface that is oblique or radial to a greater or lesser extent and from which the inlet sleeve 202 extends downwards.

The cylinder 200 thus presents a diameter in cross-section that is greater than the diameter in cross-section of the inlet sleeve.

The cylinder, the constriction surface, and the inlet sleeve respectively define an outside surface 2000, 2010, 2020 and an inside surface 2001, 2011, 2021.

In order to actuate the dispenser member, a pushbutton 3 can be provided. The pushbutton 3 can be of conventional design and can include a connection sleeve formed by an insert 30 mounted in an overcap 31. The sleeve is thus capable of connecting together the pushbutton 3 and the actuator rod 21, so as to put the outlet duct of said rod into communication with a fluid expulsion channel formed in said insert. The expulsion channel can thus open out to a swirling system, provided with transverse channels and with a swirling chamber, formed by the structural co-operation of the insert and of a nozzle fitting 32. Such a pushbutton is known in the prior art, and is therefore not described in greater detail.

Figure 2A:
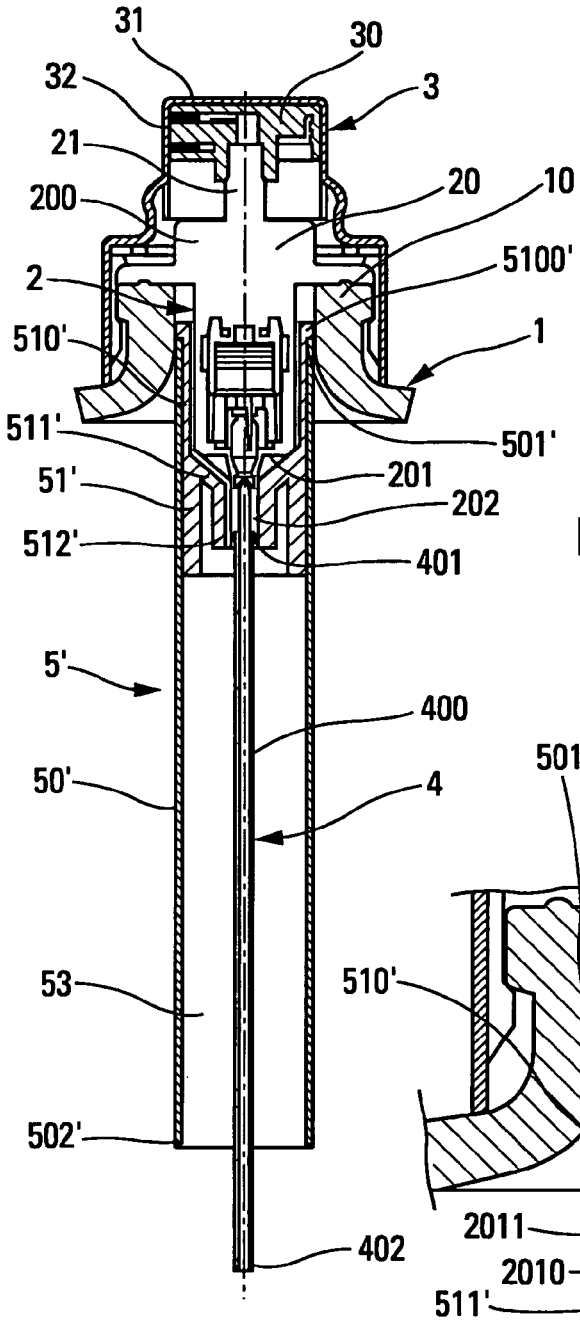
FIG. 2*a* is a view similar to FIG. 1*a* showing a dispenser device provided with a covering tube for a dip tube, and constituting a second embodiment of the invention.

The dispenser member 2 can be mounted in the opening of the neck of the receptacle in known manner by means of a fastener ring for crimping, snap-fastening, or screw-fastening. A ring for crimping is shown in FIG. 1*a*, for example, while a snap-fastener ring is shown in FIG. 2*a*. This fastening method is known in the prior art, and is therefore not described in greater detail.

The ring can also be covered by a covering hoop, as shown in FIGS. 1*a* and 2*a*, with said hoop serving either solely to perform an appearance function, or else being capable of assisting in fastening the dispenser member by co-operation with said fastener ring. Such hoops are known in the prior art, and are therefore not described in greater detail.

The operation of mounting the dispenser device in the opening of the neck of the receptacle, via the fastener ring and possibly via the hoop, is performed after a dip tube 4 and a covering tube 5 have been put into position.

The dip tube 4 is provided so as to enable fluid contained in the reservoir defined by the receptacle 1 to be taken. The dip tube comprises a tube 400 provided with bottom and top free ends 401, 402. The dip tube advantageously presents an outside diameter that is substantially equal to, or slightly greater than the inside diameter of the inlet sleeve, so as to be force-fitted in said inlet sleeve. The dip tube 4 is thus maintained securely engaged with the inside surface 2021 of the inlet sleeve 202.

The covering tube 5 is designed to be positioned around the dip tube so as to sheathe or surround at least part of said dip tube. The covering tube thus forms a sheath hiding all or part of the dip tube. In the invention, the covering tube is securely engaged with the inlet sleeve 202 of the body 20 of the dispenser member. Two embodiments of the covering tube are described below with reference to the figures.

Figure 1B:
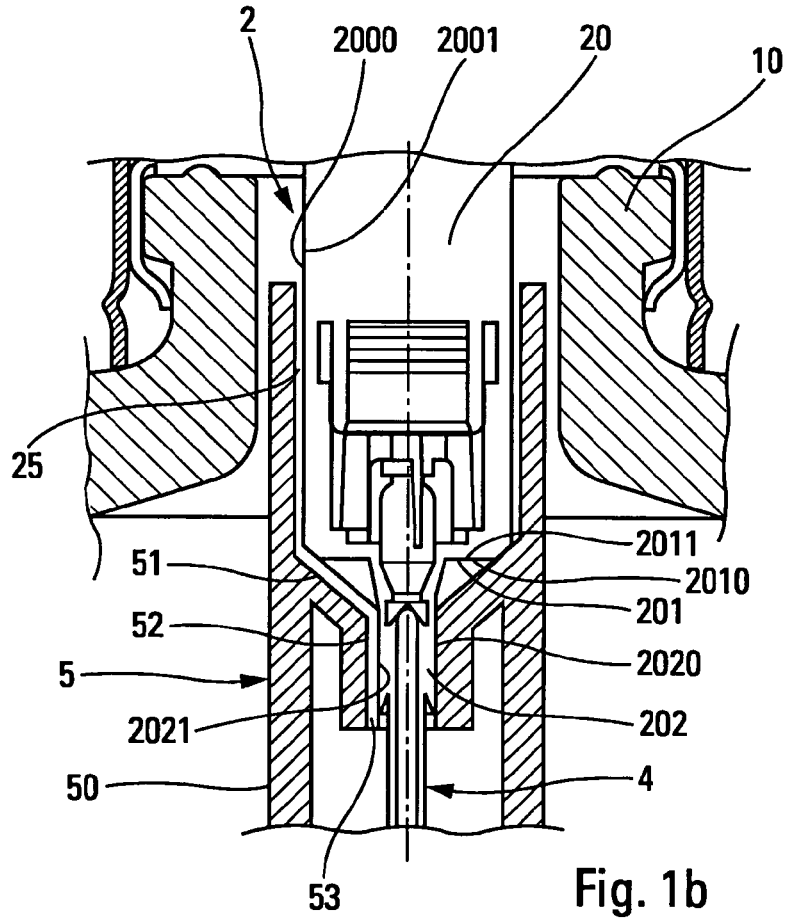
FIG. 1*b* is a larger-scale view of a fraction of the FIG. 1 dispenser device.

With reference to FIGS. 1*a* and 1*b*, the covering tube 5 comprises a cylindrical shaft 50 and an anchor sleeve 52 that are connected together by a converging flange 51. The anchor sleeve 52 thus presents a diameter in cross-section that is smaller than the diameter in cross-section of the shaft 50, and as shown, the anchor sleeve can be coaxial with the shaft 50. Advantageously, only the anchor sleeve 52 is involved in fastening the covering tube. To do this, the inside surface of the anchor sleeve 52 becomes engaged with the outside surface 2020 of the inlet sleeve 202. A gap 25 is preferably left between the inside surface of the converging flange 51 and the outside surface 2010 of the constriction surface 201, and between the inside surface of the shaft 50 and the outside surface 2000 of the cylinder 200. The creation of such a gap 25 is not necessary, but has the advantage of preventing a possible malfunction of the dispenser member 2, with the movements of the actuator rod and the movements of fluid generally tending to deform the body 20, and in particular the cylinder 200. Thus, a clamping contact of the shaft 50 on the cylinder 200 of the body 20 would prevent satisfactory sliding of the actuator rod, or indeed would prevent the rod from moving at all. However, it is possible to envisage that all or part of the converging flange could come into abutment against the outside surface of the constriction surface of the dispenser member, so as to set the final engagement position of the covering tube 5 on the inlet sleeve 202 of the dispenser member.

It should also be observed that it is possible to provide an intermediate gap 53 between the covering tube 5 and the dip tube 4 when the covering tube 5 is in its final assembly position on the inlet sleeve 202. In this event, a vent hole 53 is advantageously provided between the body 20 of the dispenser member and the covering tube 5. When the anchor sleeve constitutes the only anchor point of the covering tube on the body of the dispenser member, a vent hole, e.g. made in the form of a groove, is provided in the anchor sleeve, so that the air that is trapped in the intermediate gap 53 can escape through said vent hole, and can subsequently reach the gaps formed between the converging surface and the constriction surface, and between the shaft and the cylinder. Thus, the air can then return into the fluid reservoir or it can escape to the outside. Thus, by means of the vent system, any appearance of bubbles or of any other unattractive physical phenomena resulting from the presence of air in the intermediate gap between the covering tube and the dip tube is prevented, thereby improving the appearance effect imparted by such a covering tube, in particular when said covering tube is made out of transparent or translucent material.

Advantageously, the covering tube presents a diameter that is slightly smaller than the diameter of the opening defined by the neck of the receptacle, so that said covering tube can be inserted easily into the receptacle, while the dispenser member is being mounted therein. The preferred final position of the covering tube corresponds to the tube being positioned in the opening of the neck, e.g. mid-way up the neck. The covering tube preferably remains out of contact with the neck, and more generally with the receptacle. It should be observed that the covering tube mounted on the dispenser member can leave a fraction of the dip tube uncovered, and in particular the bottom end 401 of the dip tube. Thus, when the dispenser member is mounted in the opening of the neck of the receptacle 1, the dip tube is situated at a shorter distance from the bottom wall of the receptacle than the free bottom end 502 of the covering tube.

Figure 2B:
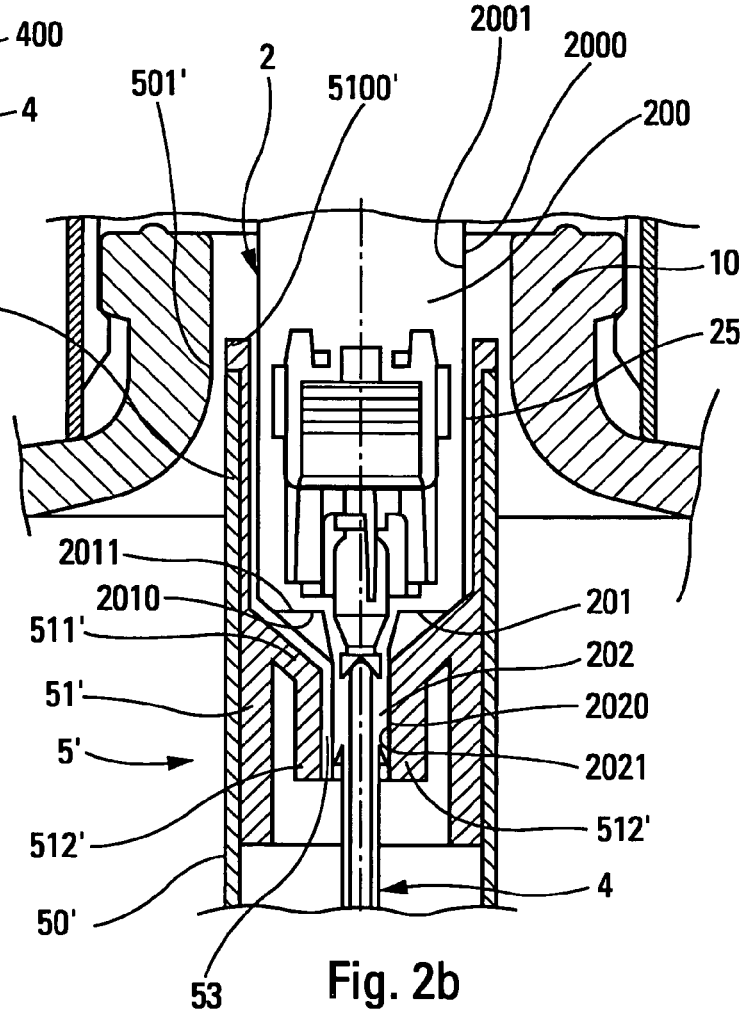
FIG. 2*b* is a view similar to FIG. 1*b* showing a fraction of the FIG. 2*a* device.

In the second embodiment shown in FIGS. 2*a* and 2*b*, the covering tube 5 differs in that it is constituted by two portions, with one portion being responsible for anchoring the covering tube 5' on the inlet sleeve 202, and the other portion being responsible for sheathing the dip tube 4.

The portion responsible for anchoring the covering tube 5' forms a bushing 51', preferably made out of plastics material, and comprising a tube 510' and an anchor sleeve 512' that are connected together by a converging flange 511'. The anchor sleeve 512' is suitable for becoming securely engaged on the inlet sleeve 202 of the body 20 of the dispenser member. In a manner similar to the preceding embodiment, the sleeve 512' can on its own fasten the covering tube around the dip tube. The tube 510' advantageously includes a top edge 5100' that extends radially outwards, and that is designed to serve as an abutment.

The portion responsible for covering the dip tube is an overtube 50', preferably made out of metal, and having an inside surface that is suitable for becoming engaged with the outside surface of the tube 510' of the bushing. Positioning the overtube around the bushing is made easier by the presence of the top edge 5100' which determines the final position of the overtube 50' around the bushing 51'. By way of example, said final position can correspond to the maximum extent to which the overtube 50' can be engaged on the bushing 51'.

The other technical characteristics described in the first embodiment are also applicable to the second embodiment, and are therefore not described again.

It should be noted that the covering tube could also be constituted merely by a tubular element, with the top end thus forming the anchor sleeve that is suitable for becoming securely engaged on the inlet sleeve of the body of the dispenser member.

Although the present invention is described above with reference to particular embodiments, any useful modifications could be applied thereto by the person skilled in the art, without going beyond the ambit of the present invention, as defined by the accompanying claims.

What is claimed is:

1. A fluid dispenser device comprising:

a transparent receptacle defining a fluid reservoir, said receptacle including a neck defining an opening;

a pump mounted in the opening of the neck, the pump being capable of delivering a quantity of fluid contained in said reservoir, the pump including a substantially cylindrical body that is terminated by an inlet sleeve, and wherein the inlet sleeve is integral with the body;

a dip tube force-fitted in the inlet sleeve and extending into the reservoir so as to deliver the fluid contained in the reservoir to the pump, once the pump has been actuated; and a covering tube sheathing at least part of said dip tube;

wherein said covering tube is fastened to the inlet sleeve of the pump; and wherein a fraction of the covering tube is positioned in the opening of the neck of the receptacle, and extends around the body of the pump.

2. A fluid dispenser device according to claim 1, in which said covering tube is not in sealed contact with the receptacle, and in particular with the neck.

3. A fluid dispenser device according to claim 1, in which said covering tube is fastened solely to the inlet sleeve.

4. A fluid dispenser device according to claim 1, in which said covering tube presents a diameter that is slightly smaller than the diameter of the opening defined by the neck of the receptacle, so that said covering tube can be inserted easily, while the pump is being mounted in the opening of the neck of the receptacle.

5. A fluid dispenser device according to claim 1, in which the receptacle comprises a side wall extending between a top end including the neck of the receptacle and a bottom end defining a bottom wall of the receptacle, said dip tube and said covering tube each presenting a free bottom end, the bottom end of the dip tube being situated closer to the bottom wall of the receptacle than the bottom end of the covering tube.

6. The fluid dispenser device according to claim 1, wherein said bushing includes a top edge that extends radially outwards and that is suitable for serving as an abutment to said overtube engaged around said bushing, said top edge being advantageously situated at the height of the neck.

7. The fluid dispenser device according to claim 1, wherein said bushing is made out of plastics material and the overtube is made out of metal.

8. The fluid dispenser device according to claim 1, wherein a vent hole is provided between the dispenser member and the covering tube so as to enable the air that is trapped in an intermediate gap situated between the covering tube and the dip tube to escape.

9. A fluid dispenser device comprising:

a transparent receptacle defining a fluid reservoir, said receptacle including a neck defining an opening;

a pump mounted in the opening of the neck, the pump being capable of delivering a quantity of fluid contained in said reservoir, the pump including a substantially cylindrical body that is terminated by an inlet sleeve, and wherein the inlet sleeve is integral with the body;

a dip tube force-fitted in the inlet sleeve and extending into the reservoir so as to deliver the fluid contained in the reservoir to the pump, once the pump has been actuated; and a covering tube sheathing at least part of said dip tube;

wherein said covering tube is fastened to the inlet sleeve of the pump; and wherein said covering tube includes a bushing in clamping engagement on said inlet sleeve, said bushing-serving as a support for an overtube, said overtube being engaged around said bushing.

10. A fluid dispenser device according to claim 9, in which said bushing includes a top edge that extends radially outwards and that is suitable for serving as an abutment to said overtube engaged around said bushing, said top edge being advantageously situated at the height of the neck.

11. The fluid dispenser device according to claim 9, wherein said bushing is made out of plastics material and the overtube is made out of metal.

12. The fluid dispenser device according to claim 9, wherein said covering tube is not in sealed contact with the receptacle, and in particular with the neck.

13. The fluid dispenser device according to claim 9, wherein said covering tube is fastened solely to the inlet sleeve.

14. The fluid dispenser device according to claim 9, wherein said covering tube presents a diameter that is slightly smaller than the diameter of the opening defined by the neck of the receptacle, so that said covering tube can be inserted easily, while the pump is being mounted in the opening of the neck of the receptacle.

15. The fluid dispenser device according to claim 9, wherein the receptacle comprises a side wall extending between a top end including the neck of the receptacle and a bottom end defining a bottom wall of the receptacle, said dip tube and said covering tube each presenting a free bottom end, the bottom end of the dip tube being situated closer to the bottom wall of the receptacle than the bottom end of the covering tube.

16. A fluid dispenser device comprising:

a transparent receptacle defining a fluid reservoir, said receptacle including a neck defining an opening;

a pump mounted in the opening of the neck, the pump being capable of delivering a quantity of fluid contained in said reservoir, the pump including a substantially cylindrical body that is terminated by an inlet sleeve, and wherein the inlet sleeve is integral with the body;

a dip tube force-fitted in the inlet sleeve and extending into the reservoir so as to deliver the fluid contained in the reservoir to the pump, once the pump has been actuated; and a covering tube sheathing at least part of said dip tube;

wherein said covering tube is fastened to the inlet sleeve of the pump; and wherein a vent hole is provided between the dispenser member and the covering tube so as to enable the air that is trapped in an intermediate gap situated between the covering tube and the dip tube to escape.

17. A fluid dispenser device comprising:

a transparent receptacle defining a fluid reservoir, said receptacle including a neck defining an opening;

a pump mounted in the opening of the neck, the pump being capable of delivering a quantity of fluid contained in said reservoir, the pump including a substantially cylindrical body that is terminated by an inlet sleeve, and wherein the inlet sleeve is integral with the body;

a dip tube force-fitted in the inlet sleeve and extending into the reservoir so as to deliver the fluid contained in the reservoir to the pump, once the pump has been actuated; and a covering tube sheathing at least part of said dip tube;

wherein said covering tube is fastened to the inlet sleeve of the pump; and wherein said covering tube includes a top end sheathing said body of the dispenser member, said top end presenting a diameter that is slightly greater than the diameter of the body of the pump so as to leave a gap between said top end and said body, and further includes an anchor sleeve that is subjacent to the top end, said anchor sleeve presenting a diameter that is smaller than the diameter of the top end, and being securely engaged on said inlet sleeve.

18. A fluid dispenser device comprising:

a transparent receptacle defining a fluid reservoir, the receptacle including a neck defining an opening;

a pump mounted in the opening of the neck, the pump being capable of delivering a quantity of fluid contained in the reservoir, the pump including a substantially cylindrical body that is terminated by an inlet sleeve;

a dip tube connected to the inlet sleeve and extending into the reservoir so as to deliver the fluid contained in the reservoir to the pump, once the pump has been actuated; and a covering tube sheathing at least part of the dip tube;

wherein the covering tube is fastened to the inlet sleeve of the pump; and wherein the inlet sleeve presents an inside surface and an outside surface, the dip tube being maintained securely engaged with the inside surface, and the covering tube being maintained securely engaged with the outside surface.

19. A fluid dispenser device according to claim 18, in which said covering tube is not in sealed contact with the receptacle.

20. A fluid dispenser device according to claim 18, in which said covering tube is fastened solely to the inlet sleeve.

21. A fluid dispenser device according to claim 18, in which said covering tube presents a diameter that is slightly smaller than the diameter of the opening defined by the neck of the receptacle, so that said covering tube can be inserted easily, while the pump is being mounted in the opening of the neck of the receptacle.

22. A fluid dispenser device according to claim 18, in which a fraction of the covering tube is positioned in the opening of the neck of the receptacle, and extends around the body of the pump.

23. A fluid dispenser device according to claim 18, in which the receptacle comprises a side wall extending between a top end including the neck of the receptacle and a bottom end defining a bottom wall of the receptacle, said dip tube and said covering tube each presenting a free bottom end, the bottom end of the dip tube being situated closer to the bottom wall of the receptacle than the bottom end of the covering tube.

24. A fluid dispenser device according to claim 18, in which said covering tube includes a bushing in clamping engagement on said inlet sleeve, said bushing serving as a support for an overtube, said overtube being engaged around said bushing.

25. A fluid dispenser device according to claim 18, in which a vent hole is provided between the dispenser member and the covering tube so as to enable the air that is trapped in an intermediate gap situated between the covering tube and the dip tube to escape.

26. A fluid dispenser device according to claim 18, in which said covering tube includes a top end sheathing said body of the dispenser member, said top end presenting a diameter that is slightly greater than the diameter of the body of the pump so as to leave a gap between said top end and said body, and further includes an anchor sleeve that is subjacent to the top end, said anchor sleeve presenting a diameter that is smaller than the diameter of the top end, and being securely engaged on said inlet sleeve.

27. A fluid dispenser device according to claim 24, in which said bushing includes a top edge that extends radially outwards and that is suitable for serving as an abutment to said overtube engaged around said bushing, said top edge being advantageously situated at the height of the neck.

28. The fluid dispenser device according to claim 24, wherein said bushing is made out of plastics material and the overtube is made out of metal.

* * * * *